US012215441B1

(12) United States Patent
Wang et al.

(10) Patent No.: US 12,215,441 B1
(45) Date of Patent: Feb. 4, 2025

(54) METHOD FOR PREPARING MEDIUM- AND HIGH-MODULUS LARGE TOW CARBON FIBERS

(71) Applicant: Jiangsu Hengrui Aerospace Industry Co., Ltd., Suzhou (CN)

(72) Inventors: Chih-Yung Wang, Suzhou (CN); Yongtao Gu, Suzhou (CN); Xuan Li, Suzhou (CN)

(73) Assignees: Jiangsu Hengrui Aerospace Industry Co., Ltd., Suzhou (CN); Jiangsu Hengrui Carbon Neutrality Technology Co., Ltd, Suzhou (CN)

( * ) Notice: Subject to any disclaimer, the term of this patent is extended or adjusted under 35 U.S.C. 154(b) by 0 days.

(21) Appl. No.: 18/808,363

(22) Filed: Aug. 19, 2024

Related U.S. Application Data

(63) Continuation of application No. PCT/CN2024/082169, filed on Mar. 18, 2024.

(30) Foreign Application Priority Data

Sep. 28, 2023 (CN) ..... 202311268510.2

(51) Int. Cl.
*D01F 9/12* (2006.01)
*D06M 10/00* (2006.01)

(52) U.S. Cl.
CPC ..... *D01F 9/12* (2013.01); *D06M 10/003* (2013.01)

(58) Field of Classification Search
CPC ..... D01F 9/12; D01F 9/00; D01F 9/08; D01F 9/14; D01F 9/32; D01F 9/324;
(Continued)

(56) References Cited

U.S. PATENT DOCUMENTS 4,197,282 A * 4/1980 Bailly-Lacresse ..... D01F 9/145 423/447.6
6,372,192 B1 * 4/2002 Paulauskas ..... D01F 9/12 423/447.7

(Continued)

FOREIGN PATENT DOCUMENTS

CN 102534866 A 7/2012
CN 202830266 U 3/2013

(Continued)

OTHER PUBLICATIONS

International Search Report dated Apr. 23, 2024; Application No. PCT/CN2024/082169.

(Continued)

*Primary Examiner* — Daniel C. McCracken
(74) *Attorney, Agent, or Firm* — DINSMORE & SHOHL LLP

(57) ABSTRACT

A method for preparing medium- and high-modulus large tow carbon fibers includes performing in-phase microwave heating on low-modulus large tow carbon fibers, and regulating and controlling a surface current density of the carbon fibers in the range of 60-330 A/m to rapidly reach graphitization temperature of the carbon fibers, thereby completing a uniform and rapid graphitization process. The medium- and high-modulus large tow carbon fibers obtained by the preparation method of the present application can have a tensile modulus reaching 300-600 GPa, and a tensile strength maintained to be 3.5-5.0 GPa, and a dispersion of the tensile modulus of the carbon fibers is less than 1.5%.

9 Claims, 5 Drawing Sheets

(58) Field of Classification Search
CPC ..... D01F 9/326; D01F 9/328; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D06M 10/003
See application file for complete search history.

(56) References Cited

U.S. PATENT DOCUMENTS

| | | | |
|---|---|---|---|
| 2014/0037533 | A1 | 2/2014 | Wang |
| 2014/0037776 | A1 | 2/2014 | Wang |
| 2018/0179696 | A1 | 6/2018 | Wang |

FOREIGN PATENT DOCUMENTS

| | | | |
|---|---|---|---|
| CN | 103541042 | A | 1/2014 |
| JP | 2018115395 | A | 7/2018 |

OTHER PUBLICATIONS

First Chinese Office Action dated Nov. 14, 2023; Application No. 2023112685102.
Written Opinion dated Apr. 16, 2024; International Application PCT/CN2024/082169; 6 pages.

* cited by examiner

METHOD FOR PREPARING MEDIUM- AND HIGH-MODULUS LARGE TOW CARBON FIBERS

CROSS-REFERENCE TO RELATED APPLICATIONS

This application is a continuation of International Patent Application No. PCT/CN2024/082169 filed on Mar. 18, 2024 and designating the United States of America and which claims priority to Chinese patent application No. 202311268510.2, filed to the CNIPA on Sep. 28, 2023, and entitled "Method for preparing medium- and high-modulus large tow carbon fibers", the entire contents of which are incorporated herein by reference.

TECHNICAL FIELD

The present application belongs to the technical field of graphitization of large tow carbon fibers, and particularly relates to a method for preparing medium- and high-modulus large tow carbon fibers.

BACKGROUND

Carbon fibers, due to their high strength and high modulus, are often used as carbon reinforcement materials to prepare high-performance composites. Generally, the carbon fibers can be divided into small tow carbon fibers (1-24K) and large tow carbon fibers (24-480K) according to the number of carbon fiber monofilaments in carbon fiber bundles. The small tow carbon fibers (1-24K) are conventional carbon fiber products with excellent mechanical properties, a tensile strength of 3500-7000 MPa and a tensile modulus of 230-680 GPa, wherein those with a tensile modulus of greater than 280 GPa are generally referred to as medium-modulus carbon fibers, and those with a tensile modulus of greater than 350 GPa are referred to as high-modulus carbon fibers. Medium- and high-modulus carbon fibers are mainly applied in product fields such as aerospace, high-end industry, and high-end sports; and a technical threshold is high, its price is 5-10 times or more that of general low-modulus carbon fibers, and the medium- and high-modulus carbon fibers are not readily available, and have a profound development potential.

While the large tow carbon fibers (24-480K) have a tensile strength of 3500-5000 MPa, and a tensile modulus of 230-280 GPa, and the large tow carbon fibers have the advantages of large single-line production capacity, reduced costs of carbon fibers by about 40%, fewer layers required for processing composites, easy availability, and the like. In recent years, the large tow carbon fibers have gradually replaced the small tow carbon fibers in the fields of automobiles, wind blades, energy buildings, shipping industry and sporting goods, and the like, however, the tensile strength, tensile modulus and other properties of the large tow carbon fibers are all weaker than those of the small tow carbon fibers, and the large tow carbon fibers are low-modulus carbon fibers, so that the application fields of the large tow carbon fibers are limited. At present, an overview of the properties of the large tow carbon fibers at home and abroad is shown in Table 1.

TABLE 1

| Manufacturer | Brand | Specification | Tensile strength (GPa) | Tensile modulus (GPa) | Elongation (%) | Bulk density (g/cm$^3$) | Fiber diameter (μm) |
|---|---|---|---|---|---|---|---|
| TORAY | PX35 | 50K | 4137 | 242 | 1.7 | 1.81 | 7.2 |
| SGL | CT50-4.0 | 50K | 4000 | 240 | 1.7 | 1.80 | 7.0 |
| | CT50-4.4 | 50K | 4400 | 255 | 1.65 | 1.80 | 6.9 |
| | CT50-4.8 | 50K | 4800 | 280 | 1.65 | 1.78 | 6.6 |
| TOHO | STS40 | 48K | 4300 | 250 | 1.7 | 1.77 | 7.0 |
| Mitsubishi | THR50 60M | 60K | 4830 | 250 | 1.93 | 1.81 | 6.0 |
| | TRW40 50L | 50K | 4120 | 240 | 1.72 | 1.81 | 6.0 |
| SINOPEC | SCF | 50K | 3980 | 237 | 1.70 | 1.79 | 7.3 |
| Jilin Guoxing | GX500 | 50K | 4500 | 235 | 1.4 | 1.77 | 6.1 |

In order to broaden the application fields of the large tow carbon fibers, this patent adopts an innovative technology to reduce a production threshold of medium- and high-modulus carbon fibers in combination with the low-cost characteristics of the large tow carbon fibers, and the large tow carbon fibers with a low modulus (<280 GPa) are quickly increased to medium and high modulus (300-600 GPa), greatly improving the performance-cost ratio of the carbon fibers. In the conventional technology, the manufacture of medium- and high-modulus carbon fibers requires high-temperature graphitization at 2000-3000° C. under specific conditions under the protection of inert gas in a high-temperature furnace. However, there are few reports on the current graphitization technology of medium- and high-modulus large tow carbon fibers at home and abroad, mainly due to the limitations of high temperature graphitization furnaces.

According to the conventional heating way, graphitization furnaces are divided into direct and indirect heating types. In the direct heating type, due to the excessive number and thickness of monofilament fibers of the large tow carbon fibers, when a heat source is transferred from a heating element in a graphitization furnace to the carbon fibers, the carbon fiber monofilaments are heated unevenly to cause varying degrees of graphitization, and partial stress concentration of the fibers is likely to occur, brittle fracture is derived, and the formation of broken filaments or fractures occurs. While the indirect graphitization furnace, such as an induction graphitization furnace, uses graphite muffle induction heating and then heat transfer to carbon fibers, so the indirect graphitization furnace has a short service life and high energy consumption in the graphitization process, making it difficult to reduce production costs; only small batch processing can be realized, and a heating temperature field is unevenly distributed on the fibers, the product property exhibits large discretization, continuous production cannot be performed, and it is difficult to achieve mechanical performance improvement.

In addition, there are a large number of defects in the arrangement of a crystallite layer itself of the large tow carbon fibers, and the graphitization process easily causes broken yarns. Therefore, there is currently no record of successful continuous production of large tow medium- and high-modulus carbon fibers.

SUMMARY OF THE INVENTION

An object of the present application is to obtain medium- and high-modulus large tow carbon fibers with uniform product properties by subjecting low-modulus large tow carbon fibers to a microwave graphitization process so that the large tow carbon fibers can have a tensile modulus reaching 300-600 GPa, and a tensile strength maintained to be 3.5-5.0 GPa, and a dispersion of the tensile modulus of the carbon fibers is less than 1.5%.

To achieve the above technical object, the present application provides a method for preparing medium- and high-modulus large tow carbon fibers, including:

performing microwave graphitization on low-modulus large tow carbon fibers, specifically performing in-phase microwave heating on the low-modulus large tow carbon fibers by a microwave graphitization furnace while regulating and controlling a current density on surfaces of the low-modulus large tow carbon fibers in the graphitization furnace, so that a current density on the surface of each carbon fiber in the microwave graphitization furnace is the same or nearly the same, the current density being in the range of 60-330 A/m, thereby rapidly and uniformly increasing the surface temperature of the large tow carbon fibers in the microwave graphitization furnace to 2000-3000° C., and completing a uniform graphitization process to obtain the medium- and high-modulus large tow carbon fibers.

Definition of the current density on the surfaces of the carbon fibers: within the microwave graphitization furnace, an electromagnetic wave with a time-dependent electric field and a time-dependent magnetic field moves in a limited space, the superposition of its forward and reflected waves forms a specific resonant electric field and resonant magnetic field distribution, when the carbon fibers are under the resonance distribution of the electromagnetic wave, the time-dependent magnetic field where the fibers are located generates a number of localized eddy-like induced currents inside the fibers, and at this time, a current flux on the carbon fibers per unit length (1 meter) is equivalent to the current density on the surfaces of the carbon fibers.

In the above technical solution, since the carbon fibers are a material with high dielectric loss in a microwave band, a penetrating microwave energy can be converted into a heat value with high efficiency, achieving the advantages of rapid temperature increase and energy saving. Its heating is mainly due to polarization loss of dipoles and a small amount of conductance loss. In a microwave electromagnetic field, the orientation of dipoles in the carbon fibers rotates and tends to be consistent, and the frequency of turning polarization can reach hundreds of millions of times per second, and the thermal kinetic energy generated can heat the carbon fibers. The heat is generated by the interaction of microwaves with the overall carbon fibers, so the heating efficiency can be greatly improved. Moreover, the in-phase microwave heating adopted in the present application can ensure that a microwave signal entering a process cavity is in-phase, achieving efficient and uniform heating of the carbon fibers in the furnace.

In addition, by adjusting the range of the current density on the surfaces of the carbon fibers so that the current density on the surface of each carbon fiber in the microwave graphitization furnace can be regulated and controlled to be the same or nearly the same, the ohmic loss heating effect of the carbon fibers can be uniformly enhanced, and the microwave energy utilization efficiency and process effect can be improved. The inventors found that when the current density on the surfaces of the carbon fibers is regulated and controlled to be in the range of 60-330 A/m, each carbon fiber undergoes molecular structure reorganization by a high temperature generated by the same dielectric loss and ohmic loss heating effects, resulting in rapid formation of high-modulus structures through molecular crystallization, a diameter of the carbon fibers is reduced from 7.0 μm to 6.3 μm, and a tensile modulus of the carbon fibers is rapidly increased to 300-600 GPa. However, when the surface current density is excessively high, exceeding 330 A/m, a severe point discharge effect of the carbon fibers in the microwave electric field will be caused, and the local temperature exceeds the maximum withstand temperature of the carbon fibers being 3000° C., forming overburning, so that the structure of the carbon fibers is disintegrated, and the tensile strength of the carbon fibers is greatly reduced, thereby weakening the effect of improving the tensile modulus.

In summary, the temperature of the large tow carbon fibers can be uniformly increased to 2000-3000° C. within 90 seconds by in-phase microwave heating and regulating and controlling the surface current density of the carbon fibers in the range of 60-330 A/m; thus, the uniform graphitization process is completed, and the tensile modulus of the low-modulus large tow carbon fibers is uniformly raised.

Further, the microwave graphitization furnace adopts an in-phase microwave design, and a dielectric periodic structure is disposed in the microwave graphitization furnace. By adopting the above technical solution, the in-phase microwave design and the dielectric periodic structure can stably concentrate and distribute a microwave energy in a distribution region of the dielectric periodic structure; and the current density on the surfaces of the large tow carbon fibers in the microwave graphitization furnace is regulated and controlled by the dielectric periodic structure.

Further, the microwave graphitization furnace includes a metal cavity, and the metal cavity is provided with an even number of microwave feed ports connected to the same microwave generator, and the even number of microwave feed ports are evenly distributed in an upper top surface and a lower bottom surface of the metal cavity, providing microwaves to the metal cavity; and each microwave feed port is further provided with a corresponding impedance matching adjuster. Generally, in microwave heating, a functional equation of microwaves generated by each magnetron is as follows:

$$\varphi = A \cdot e^{-ikx} \cdot \sin(\omega t + \theta)$$

wherein A is an amplitude, k is the number of waveguides, x is a displacement, ω is an angular frequency, t is the time, and θ is a starting phase angle. When a power supply is turned on, high voltage electricity is applied to the magnetrons, which oscillate via electron cyclotron resonance to generate an electromagnetic wave signal, and an output power is stabilized within 2-3 seconds. Since the oscillation starting time of each magnetron is a random value, in a microwave system composed of a plurality of magnetrons, a transmitting end of each magnetron radiates electromagnetic wave signals with different starting phase angles at different times. After the signals are transmitted into an interior space of the cavity through the microwave feed ports, according to the path and time of the signals, the electromagnetic field superposition of different intensities and directions is finally caused at each point in the internal space of the cavity. Due to the phase difference between multiple microwave signals, the electromagnetic field superposition results may cause constructive superposition or destructive cancellation. Therefore, each time "the power supply is turned on and microwave output is performed", different electromagnetic field superposition results may be obtained, leading to a decrease in the reproducibility of the heating effect and uneven heating. In the present application, by disposing the corresponding impedance matching adjusters at the microwave feed ports, electromagnetic impedances of the microwave feed ports may be matched and adjusted so that a signal from each microwave feed port is radiated into a microwave process cavity at the same phase and intensity, thereby reducing the electromagnetic field cancellation and the uncontrollable electromagnetic field distribution caused by a random phase difference, and achieving the best microwave energy utilization efficiency.

Further, a cavity with a size smaller than that of the metal cavity is formed in the dielectric periodic structure by a plurality of dielectric units; and the carbon fibers may pass through the cavity of the dielectric periodic structure. The dielectric periodic structure includes an upper top surface, a lower bottom surface, a front side surface, and a back side surface; and the upper top surface and the lower bottom surface each include a plurality of dielectric units arranged equidistantly in parallel, the dielectric units being arranged in a direction perpendicular or parallel to the direction of travel of the carbon fibers, or at other angles.

By adopting the above technical solution, the electromagnetic field distribution is affected by the dielectric periodic structure, and by adjusting the position of the dielectric periodic structure in the metal cavity, a specific electromagnetic field distribution can be adjusted to stably concentrate the microwave energy in the distribution region of the dielectric, thereby further concentrating the microwave energy on the carbon fibers, and enabling the current density on the surface of each carbon fiber to be the same or nearly the same, and to be controlled in the range of 60-330 A/m.

Further, each dielectric unit is made of graphite, silicon carbide, or a carbide-related combination. When the dielectric is made of graphite, the upper top surface and the lower bottom surface of the periodic structure are located at a distance of 10-35 mm from the carbon fibers, and the upper top surface and the lower bottom surface are located at a distance of 200-260 mm from the microwave feed ports. When the dielectric is made of silicon carbide, the upper top surface and the lower bottom surface of the periodic structure are located at a distance of 15-35 mm from the carbon fibers, and the upper top surface and the lower bottom surface are located at a distance of 180-260 mm from the microwave feed ports.

By adopting the above technical solution, the surface current density of the carbon fibers in the microwave graphitization furnace can be regulated and controlled to be within the range of 60-330 A/m, which is conducive to improving the tensile modulus of the carbon fibers. Experiments have shown that the tensile modulus of the carbon fibers can be increased to 300-600 Gpa, and a dispersion of the tensile modulus is less than 1.5%. In addition, during the graphitization process, a diameter of the carbon fibers is reduced from 7.0 μm to 6.3 μm.

Further, prior to the microwave graphitization, a sizing agent on surfaces of the large tow carbon fibers needs to be cleaned to maintain the purity of the carbon fibers and prevent the generation of other impurities during the graphitization process, which affects the graphitization process.

Further, after the microwave graphitization, the large tow carbon fibers need to be subjected to surface treatment, re-sizing, and drying and winding, thereby obtaining medium- and high-modulus large tow carbon fibers.

Beneficial effects of the present application: in the present application, the carbon fibers can be rapidly and uniformly heated to the graphitization temperature from the inside to the outside by in-phase microwave heating; microwaves can generate internal self-heating, and the microwave heating has low heat preservation requirements on the system compared with conventional heating; and in the microwave electromagnetic field, heat is generated by interaction of microwaves with the overall carbon fibers, the overall heating uniformity of the carbon fibers is improved, and the graphitization temperature can be quickly reached; the microwave heating increases the internal energy of carbon atoms (the transition frequency increases), accelerates the formation rate of a graphite layer in the carbon fibers, reduces the high temperature treatment time, and is beneficial for maintaining the fiber strength; and at the same time, by regulating and controlling the surface current density of the carbon fibers in the graphitization furnace by using the dielectric periodic structure, the current density on the surface of each carbon fiber is regulated and controlled to be the same or nearly the same, so that a specific magnetic field can be formed, and the microwave energy is concentrated on the carbon fibers, improving the microwave energy utilization efficiency and the process effect. After the graphitization process, the tensile modulus of the large tow carbon fibers can reach 300-600 GPa, while the tensile strength is maintained at 3.5-5.0 GPa, and the dispersion of the tensile modulus of the carbon fiber is less than 1.5%, thus the product properties are uniform.

wherein: 1—carbon fiber; 2—metal cavity; 3—microwave feed port; 4—impedance matching adjuster; 5—dielectric unit; 6—ceramic support; 7—electromagnetic wave incident on upper top surface; 8—diffraction peak of electromagnetic wave incident on upper top surface; 9—electromagnetic wave incident on bottom up surface; 10—diffraction peak of electromagnetic wave incident on bottom up surface; and 11—ohmic loss heating efficient region of carbon fiber.

DETAILED DESCRIPTION

The technical solutions of the present application will be clearly and completely described below in conjunction with the accompanying drawings. Obviously, the described examples are part of the examples of the present application, rather than all of the examples. Based on the examples in the present application, all other examples obtained by those of ordinary skill in the art without making inventive labor belong to the scope of protection of the present application.

In addition, the technical features involved in different embodiments of the present application described below may be combined with each other as long as they do not conflict with each other.

The present application provides a method for preparing medium- and high-modulus large tow carbon fibers, including:

performing microwave graphitization on low-modulus large tow carbon fibers, specifically performing in-phase microwave heating on the large tow carbon fibers by a microwave graphitization furnace while regulating and controlling a current density on surfaces of the low-modulus large tow carbon fibers, so that a current density on the surface of each carbon fiber is the same or nearly the same, the current density being controlled to be in the range of 60-330 A/m, thereby rapidly increasing the surface temperature of the large tow carbon fibers in the microwave graphitization furnace to 2000-3000° C. within 90 seconds, and completing a graphitization process to obtain the medium- and high-modulus large tow carbon fibers.

Figure 1:
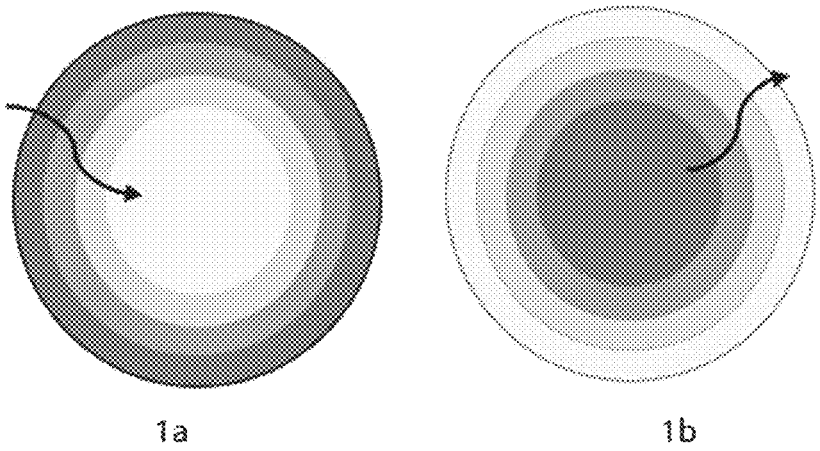
FIG. 1 is a comparison diagram of heat conduction during conventional heating and microwave heating of carbon fibers.

In this application, the heating process of microwave heating is different from that of traditional heating. Referring to FIGS. 1*a* and 1*b*, FIG. 1*a* shows the traditional heating of which a heat flow is from the outside to the inside, and FIG. 1*b* shows the microwave heating of which a heat flow is from the inside to the outside. Compared with the conventional heating, the microwave heating has low heat preservation requirements on the system, and the microwave heating can increase the internal energy of carbon atoms, increase the transition frequency of carbon atoms, accelerate the formation rate of a graphite layer in the carbon fibers, and reduce the high temperature treatment time, and is beneficial for maintaining the strength of carbon fibers. Furthermore, the present application uses in-phase microwaves, i.e., a signal from each microwave feed port is radiated into a microwave process cavity at the same phase and intensity, thereby reducing the electromagnetic field cancellation and the uncontrollable electromagnetic field distribution caused by a random phase difference, and achieving uniform heating of the carbon fibers in the microwave graphitization furnace.

On the basis of in-phase microwaves, by regulating and controlling the current density on the surfaces of the carbon fibers in the microwave graphitization furnace to be in the range of 60-330 A/m, and the current density on the surface of each carbon fiber to be the same or nearly the same, the carbon fibers undergo molecular structure reorganization by a high temperature generated by the same dielectric loss and ohmic loss heating effects, resulting in rapid formation of high-modulus structures through molecular crystallization, the diameter of the carbon fibers decreases from 7.0 μm to 6.3 μm, and the tensile modulus of the carbon fibers rapidly increases to 300-600 GPa. However, when the surface current density exceeds 330 A/m, a severe point discharge effect of the carbon fibers in the microwave electric field will be caused, and the local temperature exceeds the maximum withstand temperature of the carbon fibers being 3000° C., forming overburning, so that the tensile strength of the carbon fibers is greatly reduced, thereby weakening the effect of improving the tensile modulus.

The microwave graphitization furnace adopts an in-phase microwave design, and a dielectric periodic structure is disposed in the microwave graphitization furnace. The regulation and control of the surface current density of the carbon fibers can be achieved by the dielectric periodic structure, and the combined effect of the in-phase microwaves and the dielectric periodic structure disposed in the furnace can stably concentrate and distribute a microwave energy in a distribution region of the dielectric periodic structure, improving the stability and efficiency of the heating of the carbon fibers.

Figure 2:
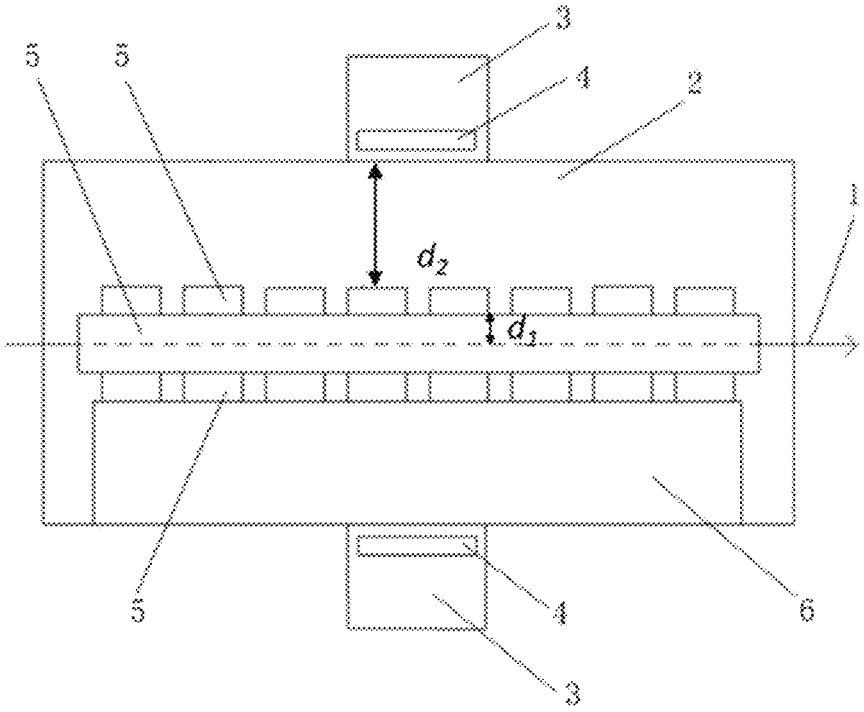
FIG. 2 is a schematic front view of a microwave graphitization furnace.
Figure 3:
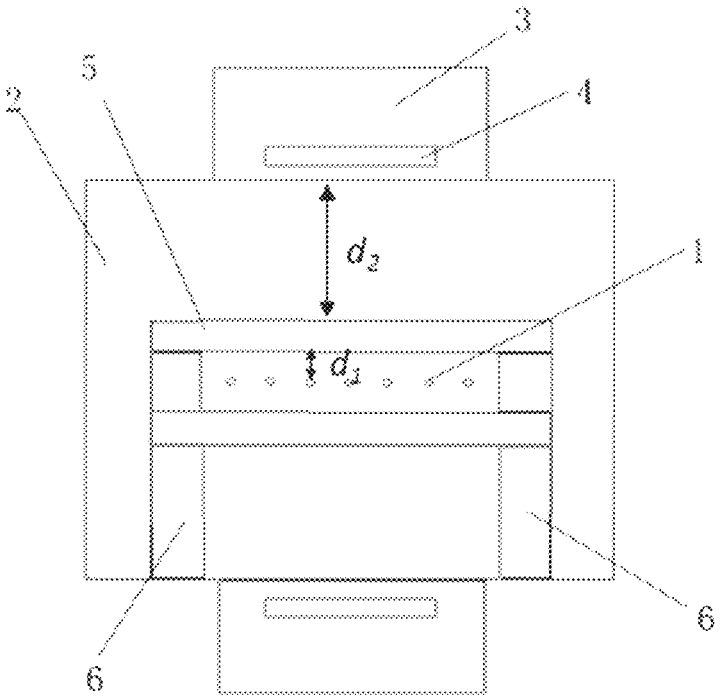
FIG. 3 is a schematic left view of a microwave graphitization furnace.

Referring to FIGS. 2 and 3, a microwave graphitization furnace used in the present application is shown, including a metal cavity 2, the metal cavity 2 is provided with an even number of microwave feed ports 3, the even number of microwave feed ports 3 are evenly distributed in an upper top surface and a lower bottom surface of the metal cavity 2, providing microwaves to the metal cavity 2, and each microwave feed port 3 is further provided with a corresponding impedance matching adjuster 4, so that electromagnetic impedances input into the microwave graphitization furnace can be adjusted so that microwave phases input into the furnace exhibit in-phase to achieve an optimal microwave energy use efficiency. The metal cavity 2 is internally provided with a ceramic support 6 on which the dielectric periodic structure is disposed, a cavity with a size smaller than that of the metal cavity 2 is formed in the dielectric periodic structure by a plurality of dielectric units 5, and the carbon fibers 1 can pass through the cavity composed of the dielectric units 5. The dielectric periodic structure includes an upper top surface, a lower bottom surface, a front side surface, and a back side surface, the upper top surface and the lower bottom surface each consisting of a plurality of dielectric units 5 arranged equidistantly in parallel, the dielectric units 5 being arranged in a direction perpendicular to the direction of travel of the carbon fibers 1. In addition, the dielectric units 5 on the upper top surface and the lower bottom surface of the dielectric periodic structure may be arranged in a direction parallel to the direction of travel of the carbon fibers 1, or at other angles. The periodic structure is made of graphite or silicon carbide, or a carbide-related combination.

A distance between the upper top surface and the lower bottom surface of the dielectric periodic structure in the microwave graphitization furnace and the carbon fibers is denoted as $d_1$, and a distance between the upper top surface and the lower bottom surface of the dielectric periodic structure and the microwave feed ports at the same side is denoted as $d_2$.

Figure 4:
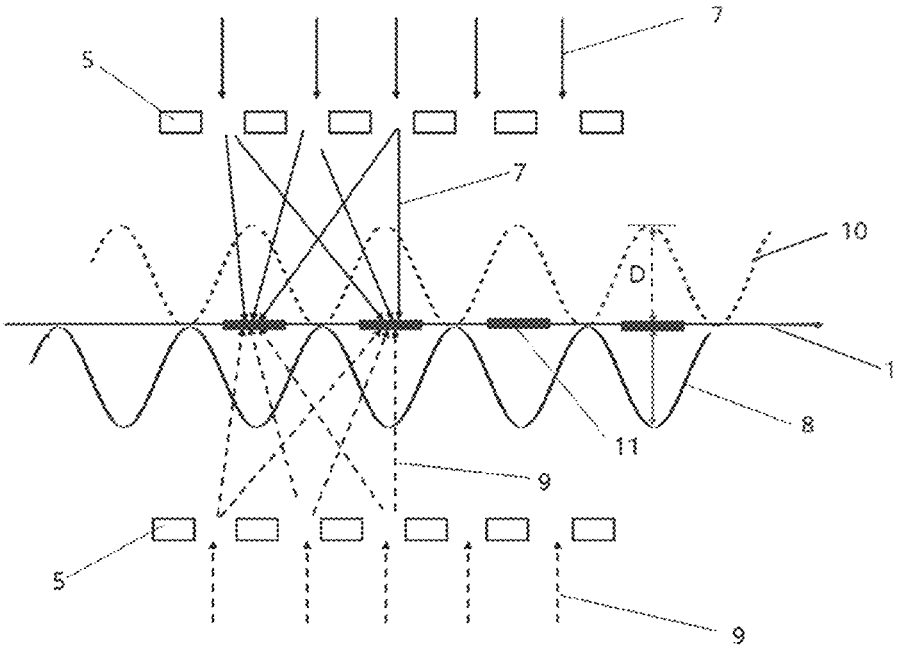
FIG. 4 is a schematic diagram of a periodic structure and in-phase microwave non-thermal effects.

The dielectric periodic structure can affect the electromagnetic field distribution, and by adjusting the position of the periodic structure in the metal cavity, a specific electromagnetic field distribution can be adjusted to concentrate the microwave energy on the carbon fibers. Taking the dielectric periodic structure shown in FIGS. 2 and 3, that is, the condition that the dielectric units on the upper top surface and the lower bottom surface of the dielectric periodic structure are arranged in the direction perpendicular to the direction of travel of the carbon fibers as an example, a schematic diagram of the periodic structure and in-phase microwave non-thermal effects is in particular shown in FIG. 4, within the microwave graphitization furnace, an electromagnetic wave 7 incident on the upper top surface passes through the dielectric units 5, forming a diffraction peak 8 of the electromagnetic wave incident on the upper top surface below the carbon fibers 1, an electromagnetic wave 9 incident on the bottom up surface passes through the dielectric units 5, forming a diffraction peak 10 of the electromagnetic wave incident on the bottom up surface above the carbon fibers 1, a vertical distance D from any point on the diffraction peak 8 of the electromagnetic wave incident on the upper top surface and the diffraction peak 10 of the electromagnetic wave incident on the bottom up surface to the carbon fibers represents the intensity of the diffraction peak of the electromagnetic wave, the larger the distance D, the larger the intensity of the diffraction peak, the diffraction peak 8 of the electromagnetic wave incident on the upper top surface and the diffraction peak 10 of the electromagnetic wave incident on the bottom up surface are both projected on the carbon fibers 1 to form an ohmic loss heating efficient region 11 of the carbon fibers, and since the direction of travel of the carbon fibers is horizontal, the ohmic loss effect of the carbon fibers is maximized while maintaining the uniformity of heating. In addition, by regulating and controlling the position of the dielectric periodic structure inside the metal cavity, the surface current density of the carbon fibers is controlled to be 60-330 A/m, the ohmic loss heating effect is enhanced, the energy utilization efficiency is improved, and the tensile modulus of the carbon fibers is increased.

Carbon fibers in in-phase microwave heating:

$$P_{Carbon\ fiber} = \iint\left(\varepsilon_S\sigma_b T_S^4 \cdot dA_S \cdot \frac{1}{4\pi d_S^2}\right)\cdot(dA_{CF}) + \int d(I^2R)$$

Carbon fibers in traditional heating:

$$P_{Carbon\ fiber} = \iint\left(\varepsilon_S\sigma_b T_S^4 \cdot dA_S \cdot \frac{1}{4\pi d_S^2}\right)\cdot(dA_{CF})$$

wherein:

$\varepsilon_s$: a radiation coefficient of a dielectric material;

$d_s$: a horizontal distance of a dielectric from a center of the periodic structure, i.e., $d_1$ in the present application;

$\sigma_b$: a Stefan-Boltzmann constant;

$A_{CF}$: a carbon fiber area;

$A_s$: a dielectric area;

I: a surface current of carbon fibers;

R: a carbon fiber radius; and $T_s$: a dielectric temperature.

As can be seen from the comparison of the above formulas, the heating efficiency of in-phase microwaves also includes ohmic loss heating compared with conventional heating. The heating efficiency and heating uniformity of the carbon fibers are greatly improved.

Figure 5A:
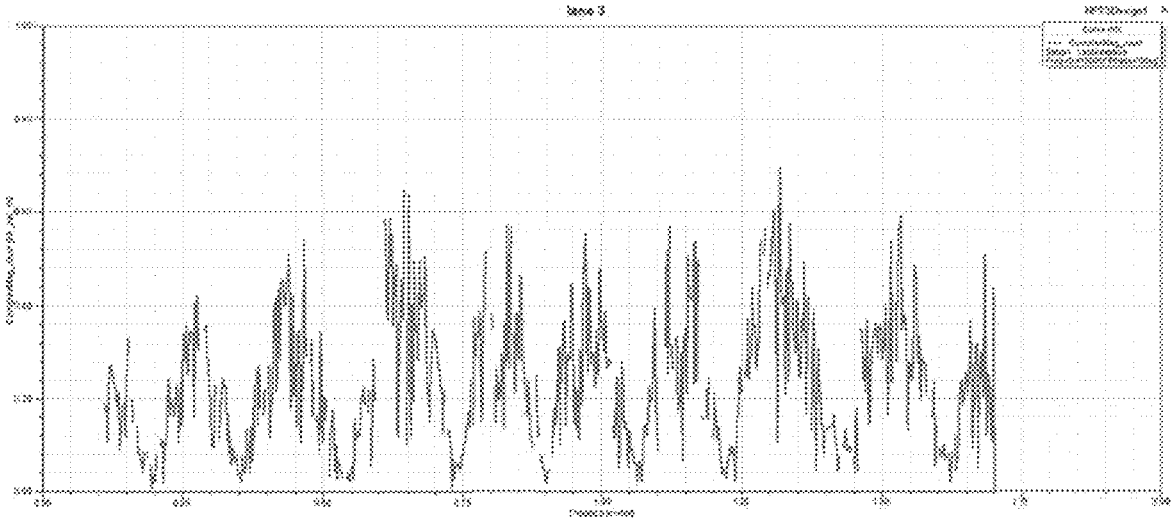
FIG. 5*a* is a schematic diagram when a surface current density of simulated carbon fibers is 170 A/m.
Figure 5B:
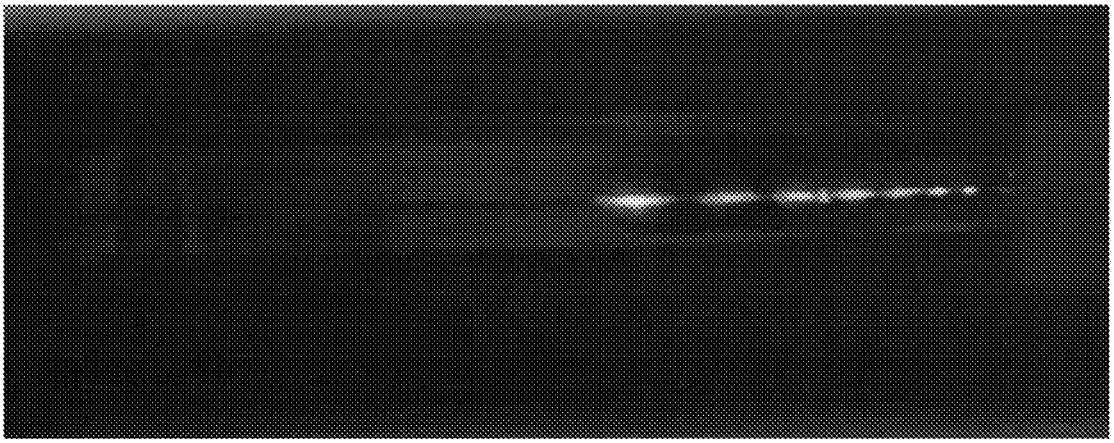
FIG. 5*b* is a graph showing the actual heating effect of the carbon fibers corresponding to FIG. 5*a;*

Referring to FIGS. 5*a* and 5*b*, FIG. 5*a* is a schematic diagram when a surface current density of simulated carbon fibers is 170 A/m, FIG. 5*b* is a graph showing the corresponding actual heating effect of the carbon fibers in the microwave graphitization furnace, and a white zone is a thermal energy concentration zone. It can be seen that the surface current density of the simulated carbon fibers corresponds to a heating zone of carbon fibers in the microwave graphitization furnace.

Further, the effect of the control of the surface current density of the carbon fibers on the tensile modulus of the carbon fibers during in-phase microwave heating in the present application is further illustrated by the following examples:

The comparative example used raw large tow carbon fibers, using PAN-based large tow carbon fibers produced by SGL, model: CT50-4.4, 50k, with a standard tensile modulus of 255 GPa, 10 samples were randomly selected and tested to record property data; and the Examples used carbon fibers obtained after microwave graphitization of raw large tow carbon fibers at different surface current densities of carbon fibers, and 10 samples were randomly selected and tested to record property data. The comparison of property data in Comparative example and examples is shown in Table 2.

TABLE 2

| | Surface current of carbon fiber (A/m) | Tensile modulus (GPa) Sample 1 | Sample 2 | Sample 3 | Sample 4 | Sample 5 | Sample 6 | Sample 7 | Sample 8 | Sample 9 | Sample 10 | Mean (GPa) | Standard deviation | Dispersion (%) |
|---|---|---|---|---|---|---|---|---|---|---|---|---|---|---|
| Comparative Example | / | 245 | 248 | 254 | 256 | 262 | 262 | 266 | 253 | 251 | 254 | 255.21 | 6.55 | 2.568 |
| Example | 0 | 265 | 272 | 279 | 302 | 282 | 283 | 275 | 293 | 288 | 300 | 283.90 | 11.99 | 4.22 |
| | 30 | 307 | 300 | 301 | 304 | 302 | 299 | 310 | 302 | 295 | 296 | 301.60 | 4.6 | 1.52 |
| | 60 | 374 | 373 | 376 | 379 | 381 | 386 | 375 | 380 | 376 | 373 | 377.31 | 4.18 | 1.109 |
| | 100 | 433 | 436 | 437 | 441 | 431 | 450 | 441 | 435 | 432 | 444 | 437.81 | 5.98 | 1.366 |
| | 170 | 509 | 523 | 525 | 518 | 521 | 526 | 530 | 530 | 524 | 510 | 521.39 | 7.31 | 1.401 |
| | 240 | 426 | 428 | 423 | 439 | 433 | 424 | 433 | 426 | 438 | 435 | 430.51 | 6.01 | 1.397 |
| | 330 | 410 | 411 | 406 | 406 | 402 | 401 | 404 | 399 | 408 | 400 | 404.76 | 4.15 | 1.024 |
| | 440 | 315 | 327 | 327 | 317 | 316 | 320 | 328 | 323 | 326 | 322 | 322.14 | 4.8 | 1.491 |
| | 500 | 302 | 302 | 299 | 310 | 301 | 300 | 304 | 302 | 312 | 305 | 303.66 | 4.25 | 1.399 |

Figure 6:
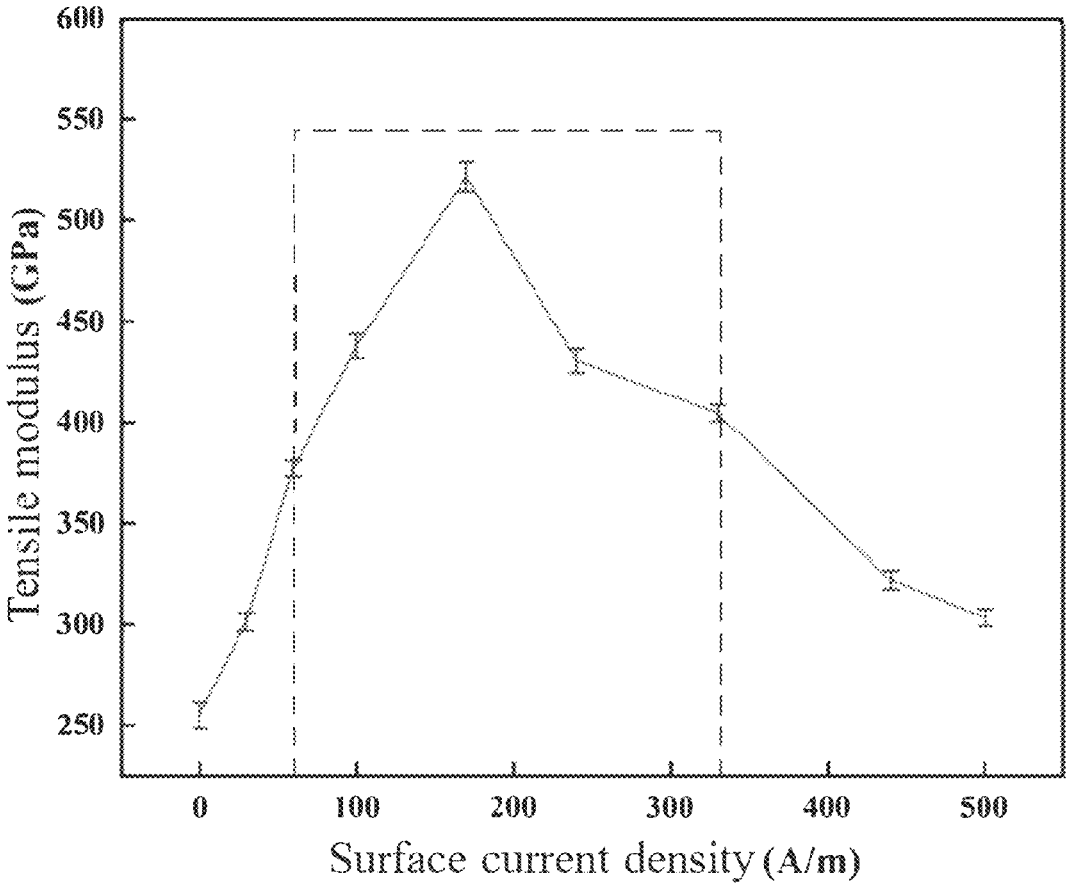
FIG. 6 is a graph of a tensile modulus of carbon fibers versus a surface current density of carbon fibers.

A graph of a tensile modulus of carbon fibers versus a surface current density of carbon fibers is formed according to Table 2, specifically referring to FIG. 6. As can be seen from Table 2 and FIG. 6, after microwave graphitization of the raw carbon fibers, the tensile modulus of the carbon fibers is changed, specifically: (1) after graphitization when the surface current density of the carbon fibers is set to be less than 60 A/m, the increase in tensile modulus of the obtained carbon fibers is small; (2) after graphitization when the surface current density of the carbon fibers is set to be within an interval of 60-330 A/m, the tensile modulus of the obtained carbon fibers is significantly increased to 300-600 GPa, and the dispersion of the tensile modulus can be controlled to be within 1.5%; and (3) after graphitization when the surface current density of the carbon fibers is set to exceed 330 A/m, the effect of improving the tensile modulus of the carbon fibers begins to weaken.

Figure 7:
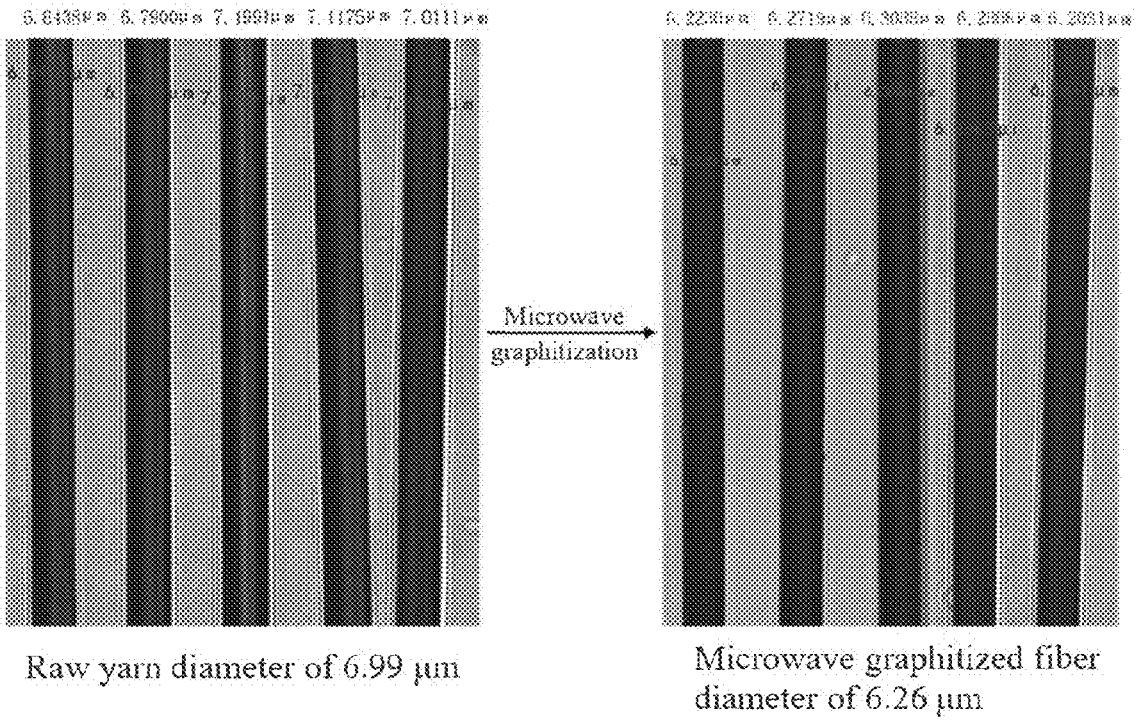
FIG. 7 is a comparison diagram of a diameter of carbon fibers before and after microwave graphitization.

Also, the inventors found that by the microwave graphitization method of the present application, the carbon fibers undergo molecular structure reorganization by high temperature generated by the same dielectric loss and ohmic loss heating effects, resulting in rapid formation of high-modulus structures through molecular crystallization, so that the diameter also changes, and the diameter decreases from 7.0 μm to 6.3 μm on average, and a comparison of a diameter change of the carbon fibers before and after graphitization is shown in FIG. 7.

In addition, with respect to the regulation and control of the surface current density of the carbon fibers, when the periodic structure is made of graphite or silicon carbide, the position relationship of the dielectric periodic structure in the metal cavity of the microwave graphitization furnace is shown in Table 3:

TABLE 3

| Example No. | Dielectric material | $d_1$ | $d_2$ | Surface current density (A/m) |
|---|---|---|---|---|
| 1 | Graphite | 10 | 260 | 500 |
| 2 | | 15 | 260 | 330 |
| 3 | | 30 | 200 | 30 |
| 4 | | 30 | 225 | 60 |
| 5 | | 35 | 215 | 100 |
| 6 | Silicon carbide | 15 | 260 | 500 |
| 7 | | 25 | 250 | 400 |
| 8 | | 30 | 180 | 30 |

TABLE 3-continued

| Example No. | Dielectric material | $d_1$ | $d_2$ | Surface current density (A/m) |
|---|---|---|---|---|
| 9 | | 30 | 210 | 240 |
| 10 | | 35 | 200 | 170 |

As can be seen from Table 3, by adjusting the position of the dielectrics inside the microwave graphitization furnace, the regulation and control of the current density on the surfaces of the carbon fibers can be achieved, when the dielectric is made of graphite, an optimal regulation and control range for $d_1$ is 15-35 mm, and an optimal regulation and control range for $d_2$ is 200-260 mm; and when the dielectric is made of silicon carbide, an optimal regulation and control range for $d_1$ is 30-35 mm and an optimal regulation and control range for $d_2$ is 200-210 mm.

The present application also provides a medium- and high-modulus large tow carbon fiber, having a tensile strength of being up to 3.5-5.0 GPa, a tensile modulus of being up to 300-600 GPa, and a dispersion of the tensile modulus of less than 1.5%.

To sum up, the method for preparing medium- and high-modulus large tow carbon fibers provided in this application can stably increase the modulus of the low-modulus large tow carbon fibers to medium and high modulus, and has a significant breakthrough in the technical field of production of medium- and high-modulus large tow carbon fibers at home and abroad.

Obviously, the above examples are merely instances for clearly illustrating the present application, and are not intended to limit the embodiments. For those of ordinary skill in the art, other different forms of variations or changes can be made on the basis of the above description. It is unnecessary and impossible to enumerate all the embodiments here. Obvious variations or changes derived therefrom are still within the scope of protection of the present application.

The invention claimed is:

1. A method for preparing medium- and high-modulus large tow carbon fibers, comprising:

performing microwave graphitization on low-modulus large tow carbon fibers, specifically performing in-phase microwave heating on the low-modulus large tow carbon fibers by a microwave graphitization furnace while regulating and controlling a surface current density of the low-modulus large tow carbon fibers in the microwave graphitization furnace, so that a current density on a surface of each carbon fiber in the furnace is uniformly controlled to be the same or nearly the same, the current density being in the range of 60-330 A/m, thereby rapidly and uniformly increasing the surface temperature of the large tow carbon fibers in the microwave graphitization furnace to 2000-3000° C., and completing a uniform graphitization process to obtain the medium- and high-modulus large tow carbon fibers.

2. The method for preparing medium- and high-modulus large tow carbon fibers according to claim 1, wherein the microwave graphitization furnace adopts an in-phase microwave design, and a dielectric periodic structure is disposed in the microwave graphitization furnace; the in-phase microwave design and the dielectric periodic structure can stably concentrate and distribute a microwave energy in a distribution region of the dielectric periodic structure; and the current density on the surfaces of the large tow carbon fibers in the microwave graphitization furnace is regulated and controlled by the dielectric periodic structure.

3. The method for preparing medium- and high-modulus large tow carbon fibers according to claim 2, wherein the microwave graphitization furnace comprises a metal cavity, the metal cavity is provided with an even number of microwave feed ports, and the even number of microwave feed ports are evenly distributed in an upper top surface and a lower bottom surface of the metal cavity, providing microwaves to the metal cavity; each microwave feed port is further provided with a corresponding impedance matching adjuster, and after electromagnetic impedances of the even number of microwave feed ports are matched and adjusted, microwave phases input into the graphitization microwave furnace exhibit in-phase to achieve an optimal microwave energy use efficiency; and a cavity with a size smaller than that of the metal cavity is formed in the dielectric periodic structure disposed in the metal cavity by a plurality of dielectric units, and the carbon fibers can pass through the cavity of the dielectric periodic structure.

4. The method for preparing medium- and high-modulus large tow carbon fibers according to claim 3, wherein the dielectric periodic structure comprises an upper top surface, a lower bottom surface, a front side surface, and a back side surface, each of the upper top surface and the lower bottom surface comprising a plurality of dielectric units arranged equidistantly in parallel.

5. The method for preparing medium- and high-modulus large tow carbon fibers according to claim 4, wherein each dielectric unit is made of graphite or silicon carbide.

6. The method for preparing medium- and high-modulus large tow carbon fibers according to claim 5, wherein when the dielectric in the microwave graphitization furnace is made of graphite, the upper top surface and the lower bottom surface of the periodic structure are located at a distance of 10-35 mm from the carbon fibers, and the upper top surface and the lower bottom surface are located at a distance of 200-260 mm from the microwave feed ports.

7. The method for preparing medium- and high-modulus large tow carbon fibers according to claim 5, wherein when the dielectric in the microwave graphitization furnace is made of silicon carbide, the upper top surface and the lower bottom surface of the periodic structure are located at a distance of 15-35 mm from the carbon fibers, and the upper top surface and the lower bottom surface are located at a distance of 180-260 mm from the microwave feed ports.

8. The method for preparing medium- and high-modulus large tow carbon fibers according to claim 1, wherein prior to the microwave graphitization of the low-modulus large tow carbon fibers, a sizing agent on surfaces of the low-modulus large tow carbon fibers needs to be cleaned.

9. The method for preparing medium- and high-modulus large tow carbon fibers according to claim 1, wherein after the microwave graphitization of the low-modulus large tow carbon fibers, the medium- and high-modulus large tow carbon fibers need to be subjected to drying and winding after surface treatment and re-sizing.

* * * * *